US005857376A

United States Patent [19]

Bowton et al.

[11] Patent Number: 5,857,376

[45] Date of Patent: Jan. 12, 1999

[54] METHOD AND APPARATUS FOR DECURLING A CURLED LID

[75] Inventors: David M. Bowton, Golden; Peter H. Lauterbach, Evergreen, both of Colo.

[73] Assignee: Coors Brewing Company, Golden, Colo.

[21] Appl. No.: 908,622

[22] Filed: Aug. 8, 1997

[51] Int. Cl.[6] ..... B21D 51/44

[52] U.S. Cl. ..... 72/404; 72/356; 72/379.4; 413/8; 413/56

[58] Field of Search ..... 72/404, 356, 414, 72/416, 379.4, 379.2; 413/8, 11, 56

[56] References Cited

U.S. PATENT DOCUMENTS 1,803,022 4/1931 Kowal ..... 72/356
2,343,006 2/1944 Gibbs .
4,667,499 5/1987 Bull ..... 72/352

FOREIGN PATENT DOCUMENTS 192837 7/1990 Japan ..... 72/379.4
104630 8/1964 Norway ..... 72/379

*Primary Examiner*—Daniel C. Crane
*Attorney, Agent, or Firm*—Klass, Law, O'Meara & Malkin, P.C.; Joseph J. Kelly

[57] ABSTRACT

Apparatus for decurling a curled lid for a container wherein three decurling units are mounted on a base having an upstanding support wall wherein the first unit provides a partially decurled lid, the second unit provides a further decurled lid for performing a desired measurement and a third unit provides a substantially fully decurled lid for performing another desired measurement.

18 Claims, 2 Drawing Sheets

METHOD AND APPARATUS FOR DECURLING A CURLED LID

FIELD OF THE INVENTION

This invention relates generally to quality control apparatus and more particularly to quality control apparatus for lids to be applied to containers.

BACKGROUND OF THE INVENTION

In the manufacture of products wherein a desired material, such as a beverage, is marketed in a sealed container, it is necessary at some stage of the manufacturing operations to provide lids to be secured on the containers. The lids are put through a required number of operations to place them in condition to be applied to the containers. One of these operations relates to the curling back of the outer portions of the lid leaving a surface to be contacted by the open end of a filled container. In many instances, this surface, including a portion of the curled portion, is provided with a coating of a sealant material. One quality control operation is to determine the inner and outer radial extent of the coating and whether too much or too little of the coating has been applied to a lid. Another quality control operation is to determine what the outer circumference of the lid was, before the curling operation, whether or not a coating of the sealant has been applied thereto. One prior art procedure known to the applicant involves the use of a tool, similar to a bottle cap opener, to peel back successive increments of the curled back portion of the container lid in a repeated series of operations. While this does provide some basis for quality control it is time consuming and not very accurate.

BRIEF DESCRIPTION OF THE INVENTION

This invention provides method and apparatus for decurling a curled lid having a coating of a sealant material thereon so that accurate measurements of the coating that was applied thereto can be determined. Also, the invention provides method and apparatus for decurling a curled lid, with or without the coating, so that accurate measurements of the outer circumference of the container lid, prior to the curling operation, can be made.

In a preferred embodiment of the invention, there is disclosed apparatus having three separate units for use in the decurling a curled lid which is taken from a supply of curled lids to be attached to containers. Each lid has a circular central body portion, an annular rib surrounding and projecting from the central body portion in one axial direction, an integral sidewall projecting from the annular rib in an opposite axial direction and forming an annular recess in association with the annular rib, an outwardly extending flange portion integral with the sidewall which flange portion comprises a first portion extending generally in a radial direction and a second portion curled back in the one axial direction and terminating in an annular edge. The apparatus comprises a frame having at least a support base and an upstanding support wall on which a plurality of units are individually mounted. A first unit is mounted on the support base and upstanding support wall for performing an initial decurling operation on the curled lid to provide a partially decurled lid. A second unit is mounted on the support base and upstanding wall for performing another decurling operation particularly on a partially decurled lid having the coating thereon to provide a further decurled lid for performing a desired measurement. A third unit is mounted on the support base and upstanding wall for performing a decurling operation particularly on a partially decurled lid having no coating thereon to provide a substantially fully decurled lid for performing another desired measurement.

One decurling operation, used when the lid has a coating of a sealant material thereon, utilizes the first and second units wherein first unit comprises a first circular die having an axis and a central supporting surface and at least one annular surface surrounding the central supporting surface. An annular rib is dimensioned to fit into the annular recess of the lid to aid in positioning the lid on the central supporting surface. An integral sidewall extends between the annular rib and the at least one annular surface. The at least one annular surface projects radially outwardly from the sidewall and is located to be contacted by a portion of the first portion of the flange portion of the lid. A second circular die has an axis coinciding with the axis of the first circular die and has an annular portion having a generally conical annular surface facing the at least one annular surface. The generally conical annular surface is inclined at a predetermined angle to the axis. Moving apparatus is provided for causing relative axial movement between the first and second circular dies. The curled lid is supported so that the annular edge is at a predetermined location so that when the generally conical annular surface of the second die contacts the annular edge it exerts a force thereon to move the annular edge in a generally radially outward direction and axially toward the at least one annular surface and moves at least other portions of the first portion of the flange portion into contact with the at least one annular surface to form a partially decurled lid. The second unit comprises a third die similar to the first circular die and a fourth circular die having a generally annular surface facing the at least one annular surface of the die and extending generally in a radial direction. The moving means of the second apparatus are moved to cause relative axial movement between the third die and the fourth die until the first portion of the flange portion of the lid and at least portions of the second portion of the flange portion of the lid to the annular edge are in contacting relationship with the at least annular surface of the third circular die to at least partially decurl the curled lid. The annular edge of the annular surface of the fourth circular die has an inner diameter substantially equal to the desired outer diameter of the annular coating on an uncurled lid.

Another decurling operation, used when the lid has no coating of a sealant material thereon, utilizes the first and third units. The third unit comprises a fifth die for supporting a at least partially decurled lid and has a circular central supporting portion having an axis. The fifth die has an annular recess integral with the central supporting surface for receiving the annular rib of the at least partially decurled lid and, in some instances, the annular rib may contact the surface of the annular recess. The fifth die has a generally radially extending annular surface that faces the flange portion of the partially decurled lid so that a concave arcuate surface thereof faces the generally radially extending annular surface and is spaced therefrom. A sixth die has an annular surface extending generally in a radial direction and is located to contact the convex surface opposite to the concave surface to apply sufficient force thereto to remove substantially any arcuate surface in the flange portion of the lid. The sixth die also has an axially extending conically shaped inner surface located to contact at least a portion of the integral sidewall of the lid to restrict radially inward movement of the integral sidewall.

The invention also comprises method for decurling a curled lid taken from a supply of curled lids to be attached to containers wherein each lid is similar to the above described lid. The first method is used when the lid has a coating of a sealant material thereon and uses above described first and second units and comprises supporting a curled lid at a relatively fixed position on the first die with the first and second portions of the flange portion being located between the generally radially extending annular surface and the generally conical surface; causing relative axial movement between said first and second circular dies and contacting the annular edge of the second portion of the flange portion with portions of the generally conical annular surface to move the annular edge in a generally radially outward direction and in a generally axial direction toward the first die. The method further comprises continuing relative movement until a partially decurled lid is formed. The method further comprises moving the partially decurled lid to the second unit and providing a fourth circular die having a generally radially extending annular surface facing the at least one annular surface on a third die similar to the first die; and moving the fourth die until an annular portion of the second portion of the lid adjacent to the annular edge is in contacting relationship with the at least one annular surface of the third die.

A second method is used when the lid has no coating of a sealant material thereon and uses the above described first and third units. The method comprises supporting a partially decurled lid so that an accurate portion of the first and second portions of the flange portion face a generally radially extending annular surface and another generally radially extending annular surface is moved into contact with the arcuate portion and the movement of the another generally radially extending annular surface is continued until the arcuate portion has been removed to form a fully decurled lid.

BRIEF DESCRIPTION OF THE INVENTION

Various embodiments of the invention are illustrated in the accompanying drawing in which.

DETAILED DESCRIPTION OF THE INVENTION

Figure 1:
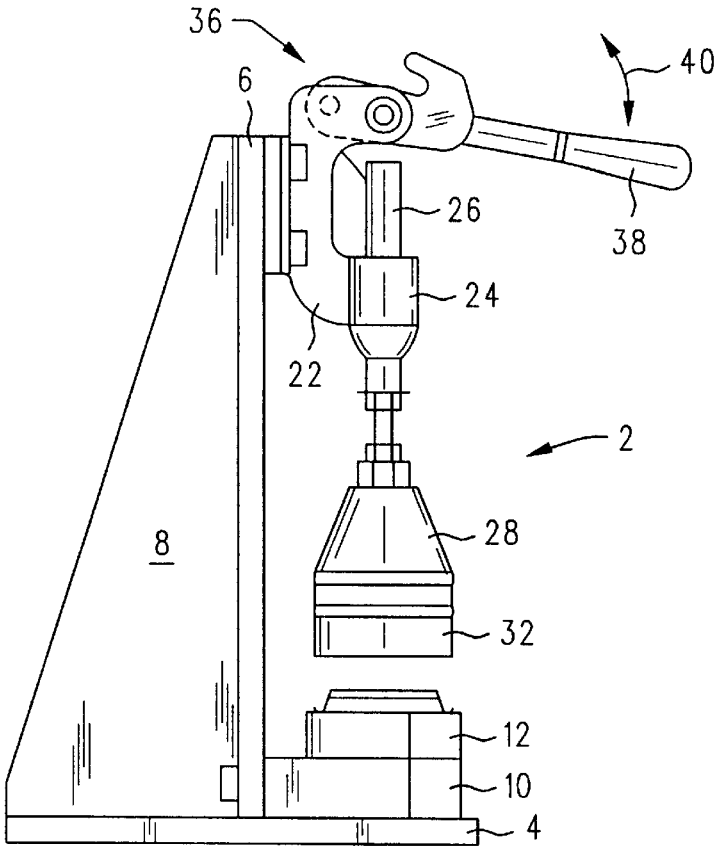
FIG. 1 is a side elevational view of the apparatus of this invention.
Figure 2:
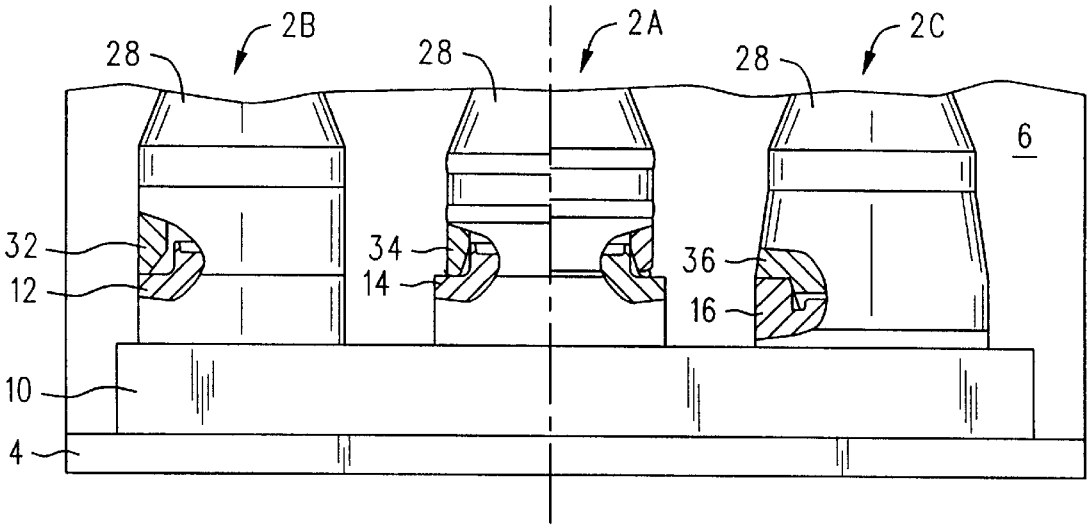
FIG. 2 is an enlarged front elevational view of the lower portion of the apparatus of this invention.

In FIG. 1, there is illustrated apparatus 2 of this invention. The apparatus 2 has a frame comprising a support base 4 and an upstanding support wall 6 mounted on the support base 4. A plurality of reinforcing plates 8 hold the support base 4 and the support wall 6 at desired relative locations. A mounting plate 10 is secured to the support base 4 and a plurality of lower dies 12, 14 and 16 are fixedly mounted on the mounting plate 10. The support base 4 is fixedly mounted on any rigid surface (not shown).

The apparatus 2 comprises three separate units 2A, B, and C with each unit having moving means 20 each comprising a bracket 22 fixedly mounted on the support wall 6. Each bracket 22 has a sleeve 24 for guiding the reciprocal movement of a rod 26 to which is mounted a housing 28 on which one of the upper dies 30, 32 and 34 is mounted for movement therewith. Camming means 36 are mounted on the bracket 22 and are actuated by movement of the handle 38 which moves in the direction of the arrow 40. As illustrated in FIG. 1, the handle 38 is in the lowermost position so that the upper die 32 of unit 2B is spaced from the lower die 12.

Figure 3:
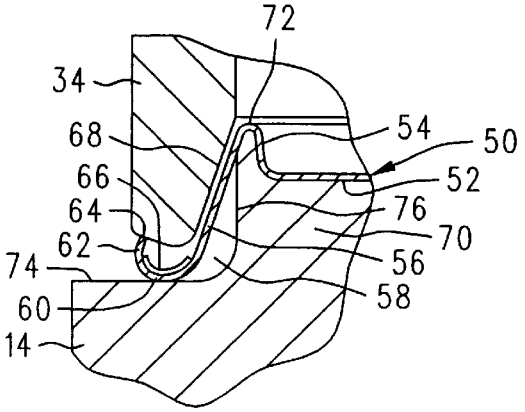
FIG. 3 is an enlarged view illustrating the operation of one of the units of this invention.

The outer portion 50 of a conventional curled container lid is illustrated in FIG. 3 in position on unit 2A and has a circular central body portion 52 an integral annular rib 54 projecting from the central body portion 52, an integral conical sidewall 56 so that an annular recess 58 is formed between the conical sidewall 56 and the annular rib 54. An integral flange portion projects radially outwardly from the conical sidewall 56 and has a first portion 60 extending generally in a radial direction and a second portion 62 curled back in an axial direction and having an annular edge 64. When desired, a coating 66 of a conventional sealant material is applied at least to portions of the second portion 62 all of the first portion 60 and a portion of the conical sidewall 56.

Figure 4:
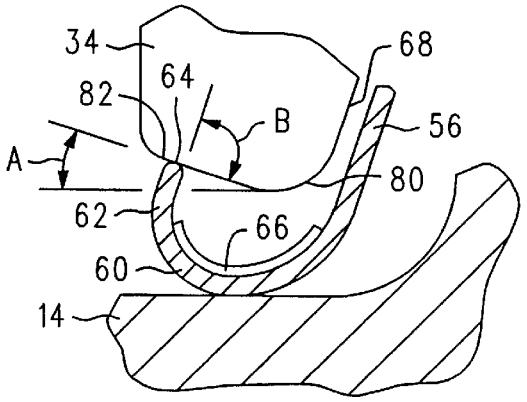
FIG. 4 is an enlarged view of a portion of FIG. 3.

The first operation in the decurling of the second portion 62 is illustrated in FIGS. 3 and 4 and involves the cooperation between the lower die 14 and the upper die 34 of unit 2A. The lower die 14 has a central supporting surface 70 for supporting the central body portion 52, a first annular portion 72 located in the annular recess 58 and a generally radially extending annular surface 74. In most instances, the first portion 60 will be slightly spaced from the generally radially extending annular surface 74 but, in some instances, they may be in a contacting relationship. The lower die 14 has an integral sidewall 76 extending between the portion 72 and the generally radially extending annular surface 74.

As illustrated partially in FIG. 4, the upper die 34 has a generally radially extending arcuate surface 80 facing the first portion 60 and a generally conical annular surface 82 facing the first portion 60. The angle A between the generally radially extending annular surface 74 and the generally conical annular surface 82 depends on the curl of the second portion 62. As illustrated in FIG. 4, the angle A is approximately 20 degrees. The handle 38 is actuated to move the upper die 34 toward the lower die 14. The angle B formed at the first contact between the annular edge 64 and the generally conical annular surface 82 is preferably greater than 90 degrees and preferably between about 91 and 95 degrees. The angle B illustrated in FIG. 4 is about 92 degrees. The upper die 34 also has a generally conical surface 68 that corresponds to the conical sidewall 56.

Figure 5:
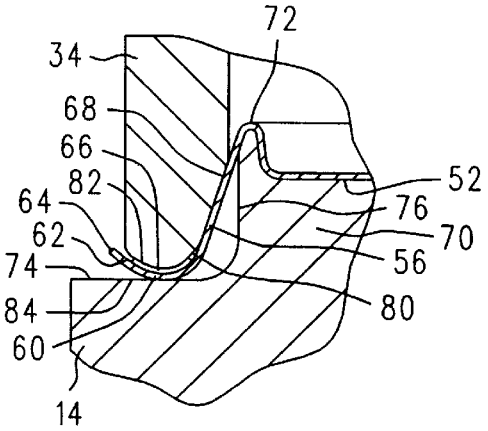
FIG. 5 is an enlarged view illustrating the lowermost position of the die of the apparatus in FIG. 3.

The movement of the upper die 34 is continued to gradually force the second portion 62 radially outwardly and axial downwardly, as illustrated in FIG. 5, until the generally conical surface 82 contact at least portions of the coating 66 on the first portion 60. The annular edge 64 projects radially outwardly from the upper die 34 and portions of the coating 66 on the first and second portions 60 and 62 are slightly spaced from the generally conical surface 82 to form a partially decurled container lid 84. The cooperation between the generally conical surface 68 and the conical sidewall 56 limits radially outward movement of the first and second portions 60 and 62. The handle 38 is rotated in the opposite direction to move the upper die 34 in an axial direction away from the lower die 14 and the partially decurled container lid 84 is removed from the lower die 14.

Figure 6:
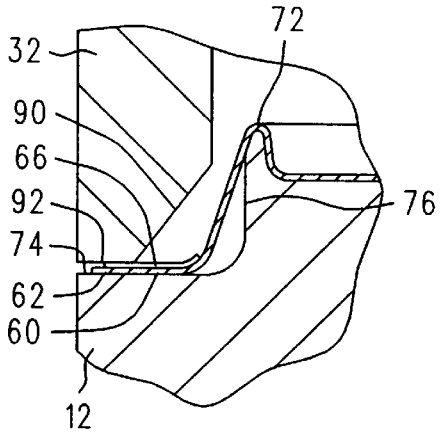
FIG. 6 is an enlarged view illustrating the lowermost position of another die of another unit of this invention.

The partially decurled container lid 84 is then placed on the lower die 12, as illustrated in FIG. 6, which lower die 12 is structurally the same as the lower die 14 so that the partially decurled container lid is supported in the same manner. The upper die 32 of unit 2B has a generally conical annular surface 90 facing the first portion 60 and a generally radially extending annular surface 92 facing at least portions of the second portion 62. The handle 38 is rotated to move the upper die 32 toward the lower die 12. As the movement of the upper die 32 is continued, the generally radially extending annular surface 92 contacts the coating 66 on the second portion 62 and moves the second portion 62 axially downwardly until it contacts the supporting surface 74. The generally radially extending annular surface 92 has an inner diameter substantially equal to the desired outer diameter of the coating 66. Therefore, when the handle 38 is rotated to move the upper die 32 away from the lower die 12, the operator can readily remove and examine the decurled container lid to determine if the correct amount of the coating 66 has been applied to the container lid or if too much or too little of the coating 66 has been applied to the container lid.

Figure 7:
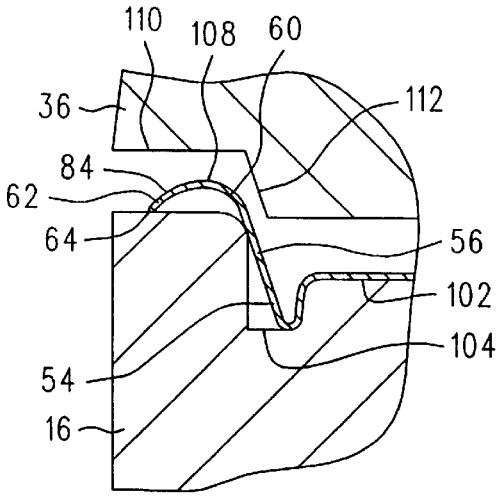
FIG. 7 and 8 are enlarged views illustrating the operation of yet another unit of this invention.
Figure 8:
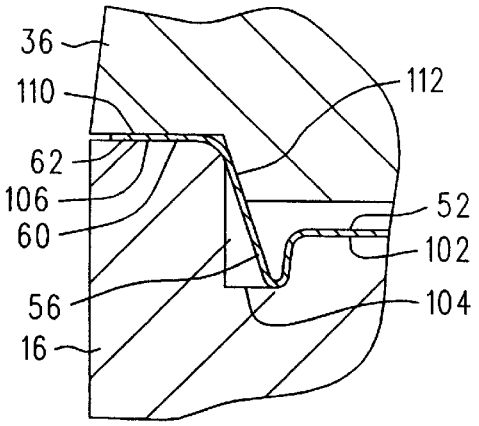

If the partially deformed container lid 84 contains no coating 66, it is inverted and placed on the lower die 16 of unit 2C. As illustrated in FIGS. 7 and 8, the lower die 16 has a central supporting surface 102 for supporting the central body portion 52, a generally radially extending annular surface 104 to form a recess in which the annular rib 54 is located and a generally radially extending annular surface 106 which in some instances may support the annular edge 64 and a portion of the first portion 60. In any event, an arcuate portion 108 exists between the annular edge 64 and a portion the first portion 60 so that the arcuate portion 108 has a concave surface facing the annular surface 106. The upper die 34 has a generally radially extending annular surface 110 facing the generally radically extending annular surface 106 and a generally conical surface 112 that corresponds to the shape of the conical sidewall 56. As illustrated in FIGS. 7 and 8, as the handle 38 is rotated to move the upper die 36 toward the lower die 16, the annular surface 110 contacts the convex side of the arcuate portion 108 to move the annular edge 64 in a radially outward direction and the arcuate portion 108 in radially outward and axially downward directions until the first and second portions 60 and 62 extend generally in a radially outward direction. Radially inward movement of the first and second portions 60 and 62 is limited by the contact between the generally conical surface 112 and the conical sidewall 56. The operation of the upper die 36 and the lower die 16 returns the first and second portion 60 and 62 to their original shape before the second portion 62 had been curled back so that an accurate measurement of the circumference of the original shape can be made to determine if it is within specifications.

The operation of the upper die 32 and the lower die 12, illustrated in FIG. 6, does not always return the first and second portions 60 and 62 to their original shape. Therefore, to measure the circumference accurately, the decurled container lid form FIG. 6 is inverted and placed on the lower die 16 so that the operation of the upper die 36 and lower die 16 can be performed to insure an accurate circumference to be measured.

It is contemplated that the inventive concepts herein described may be variously otherwise embodied and it is intended that the appended claims be construed to include alternative embodiments of the invention except insofar as limited by the prior art.

What is claimed is:

1. Apparatus for use in decurling a curled lid taken from a supply of curled lids to be attached to containers wherein each lid has a circular central body portion, an annular rib projecting from the central body portion in one axial direction, an integral conical sidewall projecting from the annular rib in an opposite axial direction and forming an annular recess, an outwardly extending flange portion integral with the sidewall and having a first portion extending generally in a radial direction and a second portion curled back in the one axial direction and terminating in an annular edge comprising:

a first circular die having an axis and a central portion and at least one supporting surface;

said first circular die having at least one generally radially extending annular surface;

said at least one annular surface located to be contacted by said first portion of said flange portion of said lid;

a second circular die having an axis coinciding with the said axis of said first circular die;

said second circular die having an annular portion having a generally conical annular surface facing said at least one annular surface;

moving apparatus for causing relative axial movement between said first and second circular dies;

said at least one supporting surface supporting said lid so that said annular edge is at a predetermined location so that when said generally conical annular surface of said second die contacts said annular edge of said second portion it exerts a force thereon to move said annular edge in a generally radially outward direction and a general axial direction toward said at least one generally radially extending annular surface.

2. Apparatus as in claim 1 and further comprising:

said moving means continuing said relative axial movement until at least a substantial portion of said first portion of said lid is generally parallel to said generally conical annular surface to form a partially decurled lid.

3. Apparatus as in claim 1 and further comprising:

a third circular die having an annular surface facing said at least one generally radially extending annular surface and extending generally in a radial direction; and said moving apparatus causing relative axial movement between said first and third circular dies until annular portions of said second portion of said lid adjacent to said annular edge are in contacting relationship with said at least one generally radially extending annular surface of said first circular die to further decurl said at least partially decurled lid.

4. Apparatus as in claim 1 and further comprising:

a third circular die having an annular surface facing said at least one generally radially extending annular surface and extending generally in a radial direction; and said moving apparatus causing relative axial movement between said first and third circular dies until annular portions of said second portion of said lid adjacent to said annular edge are in contacting relationship with said at least one generally radially extending annular surface of said first circular die to further decurl said at least partially decurled lid.

5. Apparatus as in claim 4 wherein:

said at least one generally radially extending annular surface is located on a fourth circular die.

6. Apparatus as in claim 4, wherein said curled lid has an annular coating of sealing material extending between an annular portion of said integral sidewall of said lid to an annular surface adjacent to said annular edge wherein:

said annular surface of said third circular die having an inner diameter substantially equal to the desired outer diameter of said coating on said first and second portions of an uncurled lid.

7. Apparatus as in claim 2 and further comprising:

another die for supporting said at least partially decurled lid in an inverted position;

said another die having a circular central body portion having an axis;

said another die having an annular recess integral with said central body portion for receiving said annular rib of said at least partially decurled lid;

said another die having a generally radially extending annular surface facing any concave arcuate surface of said first and second portions of said at least partially decurled lid;

an additional die having an annular surface extending generally in a radial direction; and said moving means moving said annular surface of said additional die and the convex surface opposite to said concave surface into contacting relationship and applying sufficient force thereto to remove substantially any arcuate surface in said first and second portions of said at least partially decurled lid.

8. Apparatus as in claim 7 and further comprising:

said additional die having an axially extending conically shaped inner surface located to contact at least a portion of said integral sidewall to restrict radially inward movement of said integral sidewall.

9. A method for decurling a curled lid taken form a supply of curled lids to be attached to containers wherein each lid has a circular central body portion, an annular rib projecting from the central body portion in one axial direction, an integral conical sidewall projecting from the annular rib in an opposite axial direction and forming an annular recess, an outwardly extending flange portion integral with the sidewall and having a first portion extending generally in a radial direction and a second portion curled back in one axial direction and terminating in an annular edge comprising:

providing a first circular die having a generally radially extending annular surface;

providing a second circular die having a generally conical annular surface;

supporting a curled lid at a relatively fixed position on said first die with said first and second portions being located between said generally radially extending annular surface and said generally conical annular surface;

causing relative axial movement between said first and second dies; and contacting said annular edge with portions of said generally conical annular surface to move said annular edge in generally radially directions and in generally axial directions toward said first die and in contact with said generally radially extending annular surface.

10. A method as in claim 9 and further comprising:

continuing said movement until at least a substantial portion of said first portion of said lid is generally parallel to said generally conical annular surface to form a partially decurled lid.

11. A method as in claim 10 wherein said curled lid has an annular coating of sealing material extending between an annular portion of said integral sidewall of said lid to an annular surface adjacent to said annular edge wherein:

providing a third circular die having a generally radially extending annular surface facing said generally radially extending annular surface of said first die; and causing relative axial movement between said first and third dies until annular portions of said second portion of said lid adjacent to said annular edge are in contacting relationship with said generally radially extending annular surface of said first die to provide an uncurled lid.

12. A method as in claim 10 and further comprising:

providing said generally radially extending annular surface of said third die with an inner diameter substantially even to the desired outer diameter of said coating on said first and second portions of an uncurled lid.

13. A method as in claim 9 and further comprising:

continuing said movement until at least a substantial portion of said first portion of said lid is generally parallel to said generally conical annular surface to form a partially decurled lid.

14. A method as in claim 13 and further comprising:

restraining radially inward movement of said first and second portions.

15. Apparatus for use in decurling a curled lid taken from a supply of curled lids to be attached to containers wherein each lid has a circular central body portion, an annular rib from the central body portion in one axial direction, an integral conical sidewall projecting from the annular rib in an opposite axial direction and forming an annular recess, an outwardly extending flange portion integral with the sidewall and having a first portion extending generally in a radial direction and a second portion curled back in the one axial direction and terminating in an annular edge comprising:

a support base and an upstanding support wall;

a first unit mounted on said support base and upstanding support wall for performing an initial decurling operation on said curled lid to provide a partially decurled lid;

a second unit mounted on said support base and upstanding wall for performing another decurling operation on said partially decurled lid to provide a further decurled lid for performing a desired measurement; and a third unit mounted on said support base and upstanding wall for performing a final decurling operation to provide a substantially fully decurled lid for performing another desired measurement.

16. Apparatus as in claim 15 wherein said first apparatus comprises:

a first circular die having an axis and a central portion and at least one supporting surface;

said first circular die having at least one generally radially extending annular surface;

said at least one annular surface located to be contacted by said first portion of said flange portion of said lid;

a second circular die having an axis coinciding with the said axis of said first circular die;

said second circular die having an annular portion having a generally conical annular surface facing said at least one annular surface;

moving apparatus for causing relative axial movement between said first and second circular dies;

said at least one supporting surface supporting said lid so that said annular edge is at a predetermined location so that when said generally conical annular surface of said second die contacts said annular edge of said second portion it exerts a force thereon to move said annular edge in a generally radially outward direction and a general axial direction toward said at least one generally radially extending annular surface.

17. Apparatus as in claim 16 wherein said curled lid has a coating of a sealant material on said first and second portions of said flange portion and wherein said second unit comprises:

a third circular die having an axis and a central portion and at least one supporting surface for supporting said at least partially decurled lid;

said third circular die having at least one generally radially extending annular surface;

a fourth circular die having an annular surface facing said at least one generally radially extending annular surface and extending generally in a radial direction;

moving apparatus for causing relative movement between said third and fourth circular dies until annular portions adjacent to said annular edge are in contacting relationship with said at least one generally radially extending annular surface of said third die to further decurl said at least partially decurled lid; and said annular surface of said fourth circular die having an inner diameter substantially equal to the desired outer diameter of said coating on the first and second portions of an uncurled lid.

18. Apparatus as in claim 17 wherein said third unit comprises:

a fifth die for supporting a at least partially decurled lid in an inverted position;

said fifth die having a circular central body portion having an axis for supporting said central body portion of said at least partially decurled lid;

said fifth die having an annular recess integral with said central body portion of receiving said annular rib of said inverted at least partially decurled lid;

said fifth die having a generally radially extending annular surface located so that the concave of said at least one arcuate surface faces it;

a sixth die having an annular surface extending generally in a radial direction; and said annular surface of said sixth die contacting the convex surface opposite to said concave surface to apply sufficient force thereto to remove substantially said at least on arcuate surface.

* * * * *

UNITED STATES PATENT AND TRADEMARK OFFICE

CERTIFICATE OF CORRECTION

PATENT NO. : 5,857,376
DATED : January 12, 1999
INVENTOR(S) : Bowton et al.

It is certified that error appears in the above-identified patent and that said Letters Patent is hereby corrected as shown below:

Column 3, (line 34), delete "INVENTION" and insert therefor --DRAWINGS--.

Column 4, (line 47), delete "91" and insert therefor --91--.

Column 5, (line 56), delete "form" and insert therefor --from--.

IN THE CLAIMS

Column 7, (line 29), delete "form" and insert therefor --from--.

Signed and Sealed this

Twenty-first Day of March, 2000

*Attest:*

*Attesting Officer*

Q. TODD DICKINSON

*Commissioner of Patents and Trademarks*